United States Patent [19]

Hau

[11] 4,308,732

[45] Jan. 5, 1982

[54] ADJUSTABLE DIGITAL LOCK

[76] Inventor: Luo C. Hau, No.21, Sec. 1, Ho-Ping E. Rd., Taipei, Taiwan

[21] Appl. No.: 90,031

[22] Filed: Oct. 31, 1979

[51] Int. Cl.[3] ..... E05B 13/10

[52] U.S. Cl. ..... 70/213; 70/312; 70/316

[58] Field of Search ..... 70/213, 308, 219, 209, 70/210, 218, 224, 312, 315, 316, 317, 318, 334

[56] References Cited

U.S. PATENT DOCUMENTS 1,241,471 9/1917 Williams ..... 70/213

FOREIGN PATENT DOCUMENTS 585035 9/1931 Fed. Rep. of Germany ..... 70/213

*Primary Examiner*—Robert L. Wolfe

*Attorney, Agent, or Firm*—Blair, Brown & Kreten

[57] ABSTRACT

Disclosed herein is a structure for an adjustable digital lock which is mainly characterized by its floating locking piece which controls rotation of a locking barrel, especially the one which can not be opened whenever the position of any lock ring is not proper or the opening method is not proper or when user can open the lock through listening to sounds; in which the number for such an adjustable digital lock can be easily changed by user.

8 Claims, 20 Drawing Figures

ADJUSTABLE DIGITAL LOCK

BACKGROUND OF THE INVENTION

The structure of a digital lock has been repeatedly improved but such a lock can be opened by a thief who can overcome its mechanical characteristics. For example, by means of a difference in precision of lock rings, one can rotate lock rings one by one and find the exact number for opening the lock. Some locks may be opened by holding or rotating the handle and finding the exact position of lock rings through shaking or by finding a defect in their mechanical structure.

From an analysis the inventor has found that an ordinary digital lock has a projection on its locking piece which is vibrated during a small movement.

The inventor, considering such a defect and with careful research, has designed a floating locking piece without projections for making a reliable digital lock.

SUMMARY OF THE INVENTION

Whenever the position of any lock ring is not proper, the lock is in a locking condition and not an opening condition. The locking piece is then pressed. If the handle is pressed (or rotated), the locking piece is being clipped firmly and it can not be raised.

Whenever the position of all lock rings are proper, i.e., all key slots of lock rings are on the locking piece, the locking piece is automatically raised due to the spring. Then, by means of pressing or rotating the handle, the locking piece is pushed and the lock is opened.

In practice, tension of a spring should be enough to float the locking piece. With a key having a radial slot on the lock ring, when pressing of the locking piece by each lock ring is at an improper position, no one will be able to open the lock with his mechanical sense rather than opening it the proper way.

Another characteristic of the invention is the availability of number adjustment. There is a turn section on a specially designed spring coil. Such a turn is called a number adjustor, which sets its relative position with the key slot of the lock ring and changes the numbers accordingly. The method of adjustment is only by picking up the number adjustor and turning it along the slot way.

Another characteristic of the invention is the design of steel balls which make noise. Steel balls are put into conical spaces so that whenever they are pressed, there is a noise which shows the degree of lock ring turning.

| | | | |
|---|---|---|---|
| (1) | Lock Barrel | (31) | Sliding Slot |
| (2) | Square Head | (32) | Aux. Vibrating Piece |
| (3) | Lock Cylinder | (33) | C-Type Fastener |
| (4) | Nut | (34) | Slider |
| (5) | Handle | (35) | Short Sliding Way |
| (6) | Cutting Slot | (36) | Line of Centers |
| (7) | Locking Piece | (37) | Lock Ring |
| (8) | Plate Spring | (38) | Setting Lock Ring |
| (9) | Pin | (39) | Ring Slot |
| (10) | Tip of Locking Piece | (40) | Resetting Block |
| (11) | Positioning Block | (41) | Setting Pin |
| (12) | Stop Block | (42) | Flange |
| (13) | Arched Edge | (43) | Hole |
| (14) | Brake Box | (44) | Steel Ball |
| (15) | Opening | (45) | Circular Inner Edge |
| (16) | Spring | (46) | Radial Key Slot |
| (17) | Fixing Disc | (47) | Metal Plate |
| (18) | Hole | (48) | Plastic Body |
| (19) | Tenon | (49) | Counter Sunk Screw |
| (20) | Screw | (50) | Key Slot |
| (21) | Tip Cover | (51) | Spring |
| (22) | Fixing Box | (52) | Conical Space |
| (23) | Tail Fin | (53) | Direction of Pressure |
| (24) | Floating Stop | (54) | Opening |
| (25) | Guide Post | (55) | Slot Way |
| (26) | Conical Spring | (56) | Setting Ring |
| (27) | Push Key | (57) | Hole |
| (28) | Main Vibrating Piece | (58) | Positioning Key |
| (29) | Hinge Pin | (59) | Key Slot |
| (30) | Torsional Spring | | |

DESCRIPTION OF THE PREFERRED EMBODIMENT

Figure 1:
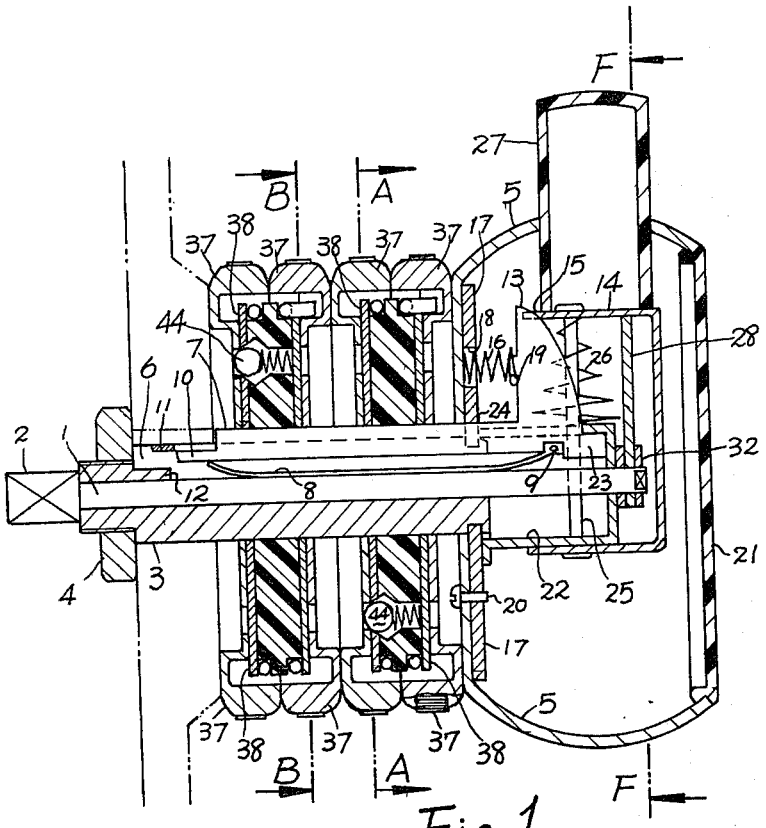
FIG. 1 is a sectional view of the lock.

FIG. 1 shows a sectional view indicating the lock in which the floating locking piece is above key slots of all lock rings and once the push key is pressed, the lock is in an opened condition.

Figure 14:
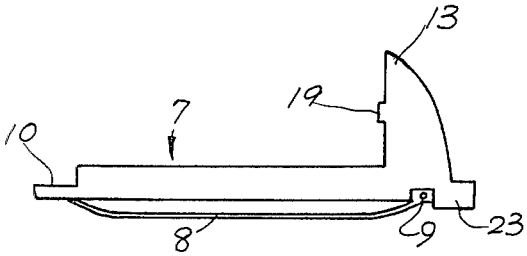
FIG. 14 is a front view of the locking piece.
Figure 15:
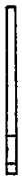
FIG. 15 is a side view of the locking piece.

The lock has a lock barrel (1). At the front of the lock barrel there is a larger square head (2). Such a square head (2) will cause extension and contraction of lock tongue (not indicated) by means of its own rotation. The lock barrel is surrounded by a lock cylinder (3). Its ends are fixed with a nut (4) and a handle (5) respectively. Its central hole provides space for rotation of the lock barrel (1). On the top of lock cylinder (3) there is a cutting slot (6) for placing a floating locking piece (7) (please refer to FIG. 14 for its detailed structure). On its bottom there is a plate spring (8). Its left lateral is an unfixed free lateral and its right lateral is fixed to the locking piece (7) by means of a pin (9) (please refer to FIG. 14). The right front end of the said locking piece (7) has a corner cut so that when all lock rings are in an opening position, locking piece (7) rises up to the key slot (50) (FIG. 20) where all locking rings are matching, front end (10) of locking piece (7) has its top contacted with a positioning block (11). When locking piece (7) is being pressed and moved forward, the said positioning block (11) can contact the front opening of the locking piece (7) and prevent the locking piece (7) from further moving (please refer FIG. 16). And when any of the lock rings is turned, locking piece (7) is being pressed downward and wholly fallen into the cutting slot (6). Then, the front end of the locking piece (7) is stopped by a stop block (12) and its forward movement becomes impossible, so that turning the lock barrel (1) is not possible and such a state is called "the locking condition" (refer to FIG. 17). At such a condition, if one is trying to open an ordinary digital lock without knowing the number, generally, he will push the handle, and then try every lock ring in order to sense a shaking. With the invention herein, since the locking piece has fallen, if the handle is pressed, the locking piece will be clipped by the pressing force and stop block (12). Therefore, even when the right number is turned, the locking piece (7) will not rise and the one who is trying to open the lock will not know that the lock is in an opened condition.

The said locking piece (7) has an arched edge (13) on the right end. Such an edge contacts with opening (15) of brake bos (14) directly. A spring (16) is also used to keep a constant and close contact between the edge (13) and opening (15). An end of the said spring (16) is fixed to hole (18) of fixing disc (17) and the other end is fixed to external of tenon (19) on the locking piece (7).

Said fixing disc (17) is fixed to the right hand extremity of lock cylinder (3). Handle (5) is directly or indirectly fixed to fixing disc (17) and lock cylinder (3) by means of screws (20) (3 screws in the embodiment herein). Handle (5) is covered with a top cover (21) (FIG. 1).

On the right side of said fixing disc (17) there is a fixing box (22). At the right end of said locking piece (7) there is a tail fin (23), the top of which is controlled by the fixing box (22). The floating stop (24) at fixing disc (17), controls the maximum floating of said locking piece (7).

The said tail fin (23) has a small projection at its bottom so that when the locking piece (7) is pressed down, said projection can stop the lock barrel (1) and improve stability of the locking piece (7) while going downward.

Figure 12:
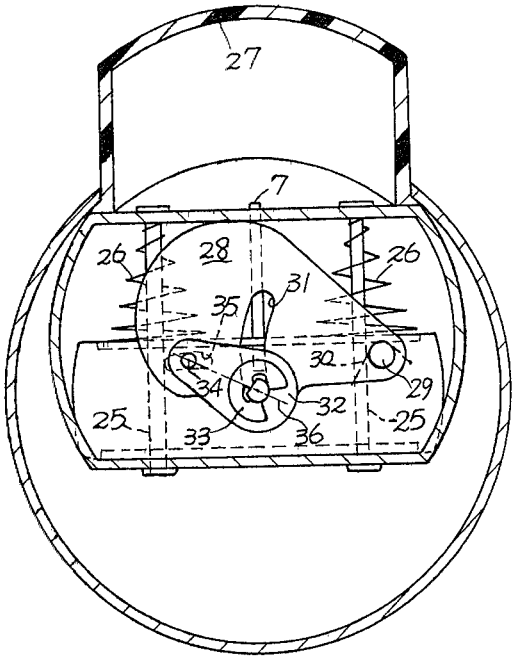
FIG. 12 is a sectional view taken along line F—F of FIG. 1.
Figure 13:
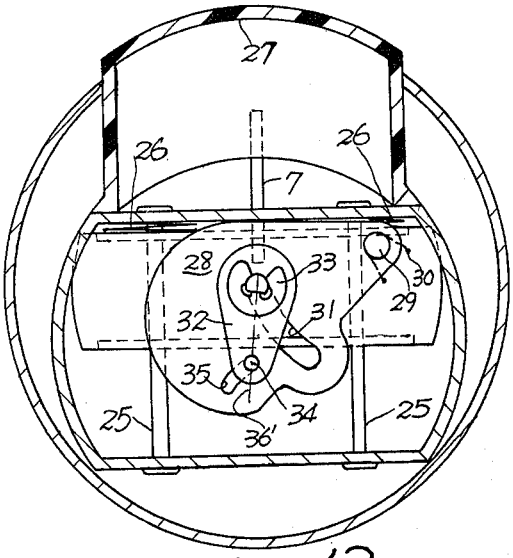
FIG. 13 is a sectional view taken along line G—G of FIG. 16.

On the fixing box (22) there is a brake box (14), which has two guide posts on both sides of the locking piece (7) (refer to FIGS. 12–13). A concial spring (26) is designed between the fixing box (22) and brake box (14) so that when the brake box (14) is being pressed down, it can be as close as possible to the fixing box (22) (refer to FIG. 13). Above the brake box (14) there is a push key (27) which is projected beyond the handle (5). By means of two springs (26) and pressing by hand on (27), brake box (14) moves up and down. In addition, there is a transmission mechanism between lock barrel (1) and brake box (14). This mechanism transfers the up and down linear movement of push key (27) into rotating movement of lock barrel, (1) which will be discussed in detail soon.

Figure 2:
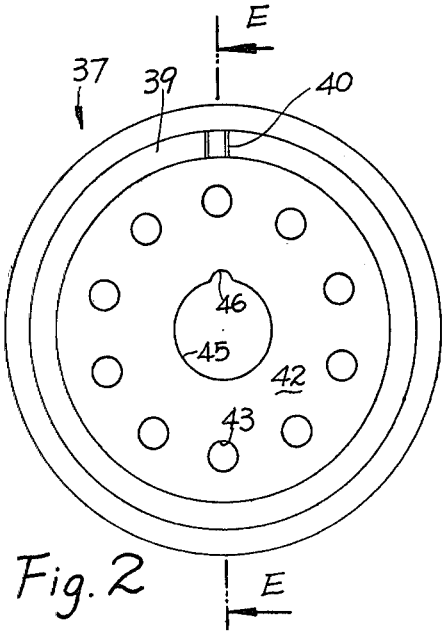
FIG. 2 is a front view of the lock.
Figure 3:
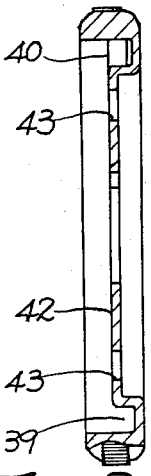
FIG. 3 is a section view taken along line E—E of FIG. 2.

Referring to FIG. 1, surrounding the lock cylinder (3) there are four lock rings (37) and two setting lock rings (38). Structure of the lock ring (37) is shown in FIGS. 2–3. In the ring there is a ring slot (39). At a certain place of the ring slot (39) there is a resetting block (40). Said ring slot (39) allows setting pin (41) of the setting lock ring (38) to move therewithin and by the stopping of setting pin (41) with a resetting block, the number can be reset prior to opening of lock.

The said lock ring (37) has a flange (42) which has ten holes (43) of equal distance. Such holes match with steel ball (44) on the setting lock ring (37). When lock ring (37) is turned, the degree of turning can be clearly read.

Figure 18:
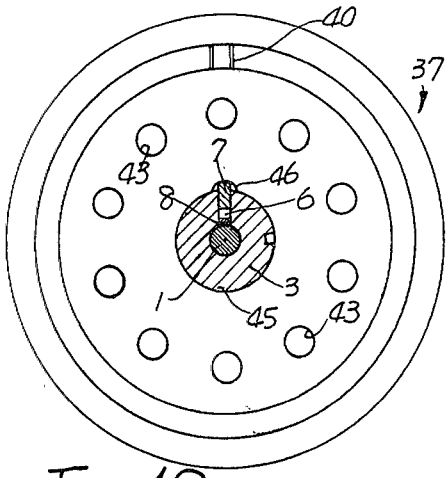
FIG. 18 is a sectional view taken along line B—B of FIG. 1.

At the center of lock ring (37) there is a hole (45) for passing through lock cylinder (3) and there is a key slot (46) for passing locking piece (7) (refer to FIG. 18).

Figure 5:
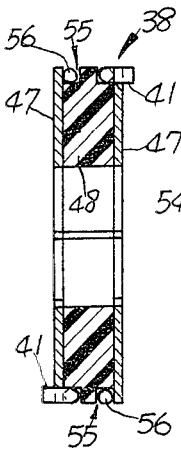
FIG. 5 is a sectional view taken along line C—C in FIG. 4.
Figure 4:
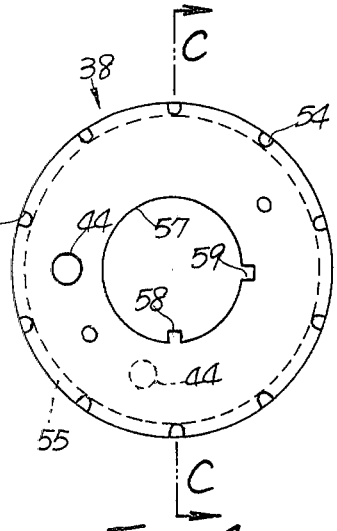
FIG. 4 is a front view of the setting lock ring.
Figure 7:
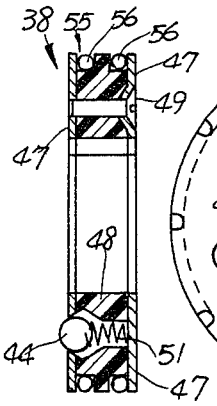
FIG. 7 is a sectional view taken along line D—D of FIG. 4.
Figure 6:
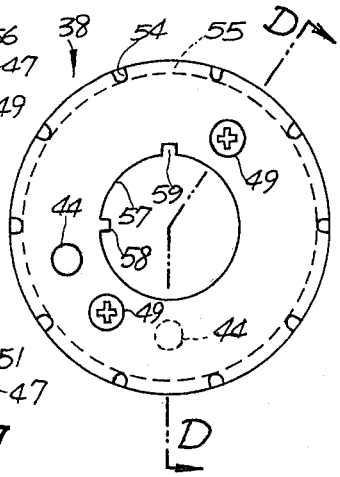
FIG. 6 is a back view of the setting lock ring.
Figure 8:
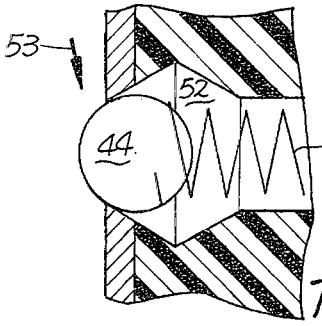
FIG. 8 is an enlarged view of the steel ball in setting the lock ring prior to its being pressed.
Figure 9:
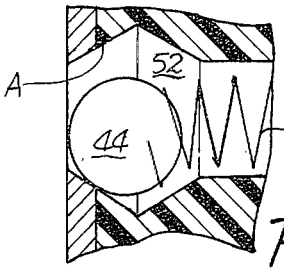
FIG. 9 is an enlarged view of steel ball in setting the lock ring which is being pressed.

FIGS. 4–7 show the detailed structure of the setting lock ring (38). FIG. 5 is a sectional view taken from line C—C of FIG. 4. FIG. 6 is a sectional view taken from line D—D of FIG. 6. FIG. 4 and FIG. 6 are front views of a setting lock ring (38) at two different viewing directions. As shown in FIG. 6, a setting lock ring (38) is composed of two metal plates (47) with a plastic body (48) between them. It is fixed with two counter sunk screws (49) (refer to FIG. 6). Each setting lock ring (38) has a steel ball (44) and the steel ball (44) tends outwardly by means of a spring (51). A space for moving the steel ball (44) is shown in FIGS. 7–8. It is a conical space (52). When a steel ball (44) is subject to pressure in the arrow direction (53), it will fall into the position shown in FIG. 9. When external force disappears, the ball hits wall surface A directly as indicated by FIG. 9 and thus there is a noise which tells degree of the degree of turning of a lock ring (37).

Figure 10:
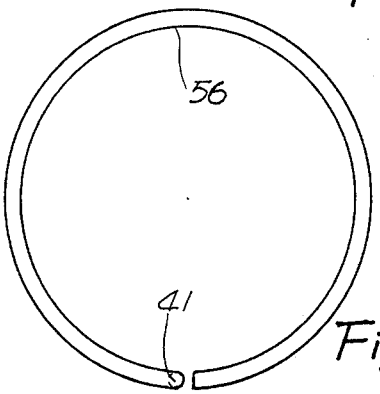
FIG. 10 is a top plan view of the setting spring.
Figure 11:
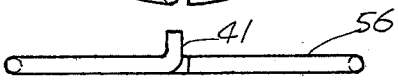
FIG. 11 is a front view of the setting spring.

Both flanges of setting lock ring (38) have ten equidistant openings (54) respectively. An inner ring of said openings is marked with 0, 1, 2, . . . 9 correspondingly. The flange of said setting lock ring (38) has two slot ways (55) for placing of an elastic setting ring (56). The structure of said setting ring (56) is shown in FIG. 10. An end of it is turned toward the axis to form a setting pin (41) which is to be held in between openings (54) and projected outward. In selecting a number, one will only have to place the setting pin (41) in the required opening (54).

Figure 20:
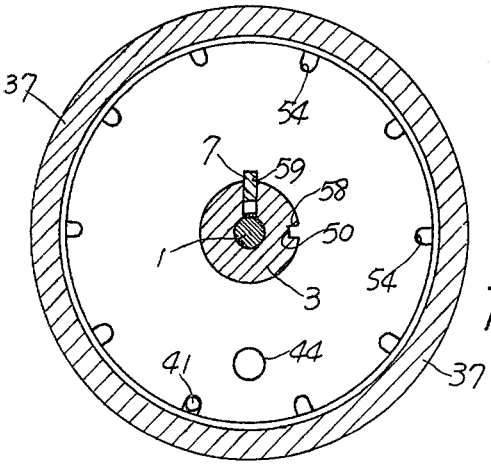
FIG. 20 is a sectional view taken along line A—A of FIG. 1.

At the center of said setting lock ring (38) there is a hole (57) for inserting of the lock cylinder (3). There is also a positioning key (58) and a key slot (59). The positioning key 58 is to slide along key slot (50) of the lock cylinder (3) (as shown in FIG. 20) in order to fix the setting lock ring (38) and prevent it from rotating, while the key slot (59) is for passing and floating of the locking piece (7).

As shown in FIG. 1, the embodiment herein has four lock rings (37) and two setting lock rings (38), wherein a setting lock ring (38) is located between two lock rings (37) and the setting lock ring (38) is contacting booth lock rings (37). Steel ball (44) is fixed at lock ring (37) by means of spring tension (51) at the hole (43). Setting pin (41) on both sides of the setting lock ring (38) projects into the ring slot (39) on the lock ring (37) beside it. Because of the setting lock ring (38), the pin is fixed and not movable. Either at the locking or opening condition, the setting lock ring (38) can rotate freely along lock cylinder (3). Therefore, in the opening process, all lock rings (37) have to be turned till the resetting blocks (40) contact with and project into the ring slots (39). And then, given a predetermined number sequence, rotate each lock ring (37) and therefore the steel balls (44) which are pressed and fall into holes (43). By means of sensing the contacting noise from the steel balls (44) against the wall surface A is conical space (as shown in FIG. 9), one will know when the number desired is attained and the key slot (46) of lock ring (37) is matched with the locking piece (7). The locking piece (7), as shown in FIG. 1, floats above the key slots (46) of all lock rings (37) so that the lock is in an opened condition. The invention can be opened at night time or in a dark place by human sense and the noise of the steel balls (44) without the draw backs of ordinary digital locks which has its members marked on its surfaces and requires light when opening the lock at night or in a dark place.

Figure 17:
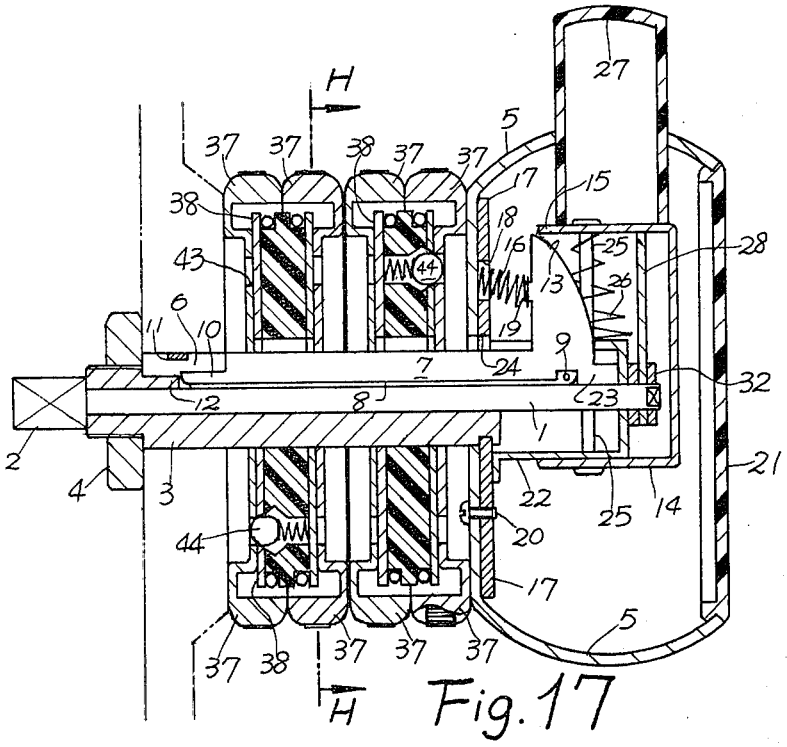
FIG. 17 is a sectional view of the lock in an locked condition.
Figure 19:
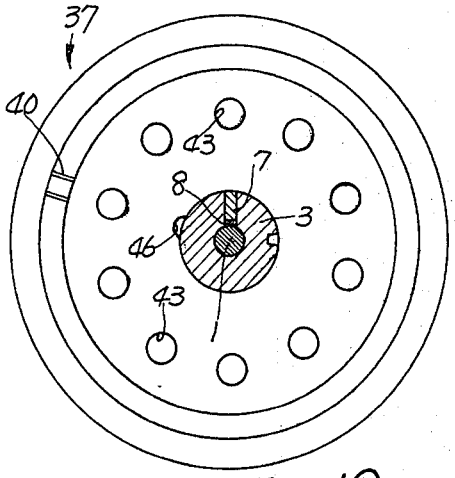
FIG. 19 is a sectional view taken along H—H of FIG. 17.

For locking the lock, as shown in FIG. 17, one will only have to rotate one or more lock rings (37) which causes the locing piece (7) to fall and press into the cutting slot (6) of lock cylinder (3) (refer to FIG. 19). At this moment, since the front terminal of the locking piece is engaged by the stop block (12) it can not move forward further. Since the push key (27) is not able to be pressed downward for turning the lock barrel (1), then the lock tongue will not be moved (not indicated in the drawing) for opening. After locking, locking piece (7) is "floating" due to the uniform tension of spring (8) and so, it will not be opened easily because of the irregular floating due to stop block (12). A sample for this embodiment is available for experimental and trial use. Since the locking piece (7) will fall uniformly, no one can sense contact between the locking piece (7) and the key slot (46) of lock ring (37) and then find the position of key slot (46). Even if there were a possibility of irregular floating of the locking piece 7 (in fact it is not possible) while ring (37) is being turned, the steel balls (44) are being pressed and there is a force applied thereto which force is larger than the floating force of locking piece (7). Furthermore, when the key slot (46) of the lock ring (37) matches with the locking piece (7), at that instant, the steel ball (44) falls into the hole (43), and since the force received by the steel ball (44) is large, the impact is bigger than the impact of locking piece (7) to key slot (46).

The following describes how lock barrel (1) is rotated to a certain degree by means of pressing the push key (27) in an open condition as indicated in FIG. 1 in order to make the lock tongue contract for opening the door.

Referring to FIGS. 1, 12, and 13, there is shown a mechanism consisting of a main vibrating piece (28), which oscillates with hinge pin (29) as a pivot. There is a torsional spring (30) at hing pin (29) so that the main vibrating piece can keep a close contact with brake box (14). Furthermore, the main vibrating piece (28) has an arched sliding slot (31) on it. The sliding slot (31) provides a path for oscillation of the main vibrating piece (28) so that the scope of oscillation is limited to the sliding slot (31). On the lock barrel (1) there is an auxillary vibrating piece (32) which has a terminal fixed to the lock barrel (1) by means of C-type fasterer (33) and the other terminal slides within the short sliding way (35) of the main vibrating piece (28). Please note the difference between FIG. 12 and FIG. 13. FIG. 12 is at normal condition without pressing key (27) down and the FIG. 13 is when key (27) is pressed, i.e., with the key (27) pressed down, lock barrel (1) is turned and the door is opened.

As shown in FIG. 12, the brake box (14) is subject to tension of the spring (26) and is pushed to the highest position algon with the push key (27). At this moment the position of lock barrel (1) is as that of line of centers (36) (FIG. 12). In FIG. 12, when push key (27) is pressed down, the main vibrating piece (28) turns downward. Lock barrel (1) is driven by the auxillary vibrating piece (32) and then the door is opened (please compare the line of centers (36) and change in degree of (36') for details).

Figure 16:
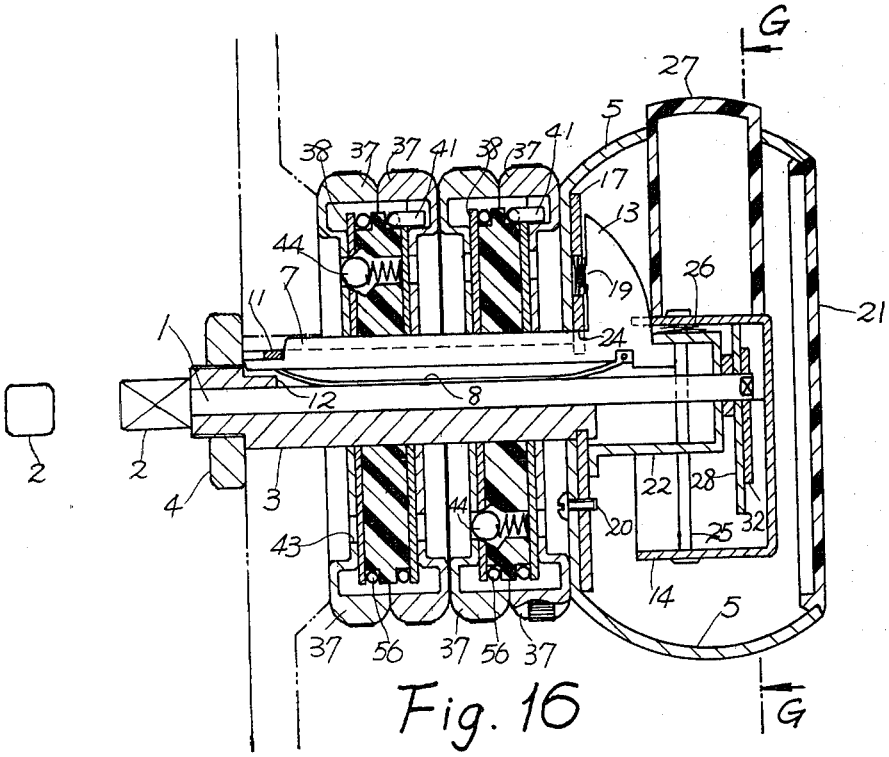
FIG. 16 is a section view of the lock in an opened condition.

As shown in FIG. 16, when the push key (27) is in a pressed condition, the floating locking piece (7), since there is no stop at its front, allows the push key (27) to be pressed down and this is the so called open condition.

As shown in FIG. 1 and FIG. 17, when lock ring (37) is at a proper position, locking piece (7) can be floated above key slot (46) and if the lock ring (37) is not in a proper postion, the locking piece (7) is pressed into the cutting slot (6).

FIG. 20 shows the installation of setting lock ring (38) at lock cylinder (3).

I claim:

1. An adjustable digital lock comprising in combination:

a lock barrel (1) having a terminus (2) adapted to latch and unlatch a lock tongue, a locking piece (7) disposed along an axial face of said barrel and separated therefrom by a plate spring (8), said locking piece having a tip (10) adapted to encounter a stop block (12) and an arched edge (13) remote from said tip, a plurality of lock rings (37) overlying said locking piece and said lock barrel each including a radial key slot (46) for migration therein of said locking piece by the force of said plate spring when aligned therewith, a handle (5) overlying said arched end and an associated segment of said lock barrel, a push key (27) disposed on said handle adapted to be displaced within said handle against spring pressure, said push key adapted to coact against said arched edge translating said locking piece axially when said locking piece is within said radial key slot thereby causing said tip to ride over said stop block.

2. The device of claim 1 including audible means on said lock ring for orienting said radial key slots.

3. The device of claim 2 including means for changing the orientation of said audible means.

4. The device of claim 3 wherein said arched edges is biased against said push key and its motion by a spring (16).

5. The device of claim 4 wherein said push key is operatively connected to a brake box (14) which is displaceable with said push key, said brake operatively connected to said lock barrel to rotate said lock barrel upon depression of said push key into said handle.

6. The device of claim 5 wherein said brake box is operatively connected to said lock barrel by means of a fixing box (22) mounted to said handles, at least on guide post (25) extending therethrough and connected at both ends to said brake box, a spring (26) disposed between said fixing box and said brake box providing said spring pressure between said push key and said handle, said spring overlying said guidepost, a main vibrating piece (28) hinged (29) to said fixing box and moved against spring pressure (30) by said brake box, an auxilliary vibrating piece (32) fixed to said lock barrel and keyed (34) to ride in a slot (35) in said main vibrating piece, whereby movement of said main vibrating piece rotates said lock barrel through said auxillary vibrating piece.

7. The device of claim 3 wherein said means for changing the orientation of said audible means comprises a pair of spaced parallel setting lock rings (38) and an interposed body (48), a pair of annular slot ways (55) on said body within which setting rings (56) are disposed, said setting rings having an outstanding setting pin (41) adapted to register with one of a plurality of openings (54) on said setting lock rings which nest within said lock ring.

8. The device of claim 7 wherein said audible means comprises a hole on setting lock ring, a ball (44) in said body biased (51) against said hole, a plurality of holes (43) on said lock ring adapted to register with said ball, and a resetting block 40 on said lock ring adapted to register with said resetting pin.

* * * * *